US009332804B2

(12) United States Patent
Chen

(10) Patent No.: US 9,332,804 B2
(45) Date of Patent: May 10, 2016

(54) MASSAGING SHOE PAD

(71) Applicant: FAR EAST UNIVERSITY, Tainan (TW)

(72) Inventor: Yu-Gang Chen, Tainan (TW)

(73) Assignee: FAR EAST UNIVERSITY, Tainan (TW)

( * ) Notice: Subject to any disclaimer, the term of this patent is extended or adjusted under 35 U.S.C. 154(b) by 0 days.

(21) Appl. No.: 14/271,750

(22) Filed: May 7, 2014

(65) Prior Publication Data

US 2014/0331526 A1 Nov. 13, 2014

(30) Foreign Application Priority Data

May 13, 2013 (TW) ..... 102116807 A

(51) Int. Cl.
*A43B 7/14* (2006.01)
*A43B 13/38* (2006.01)
*A43B 17/00* (2006.01)

(52) U.S. Cl.
CPC ..... *A43B 7/149* (2013.01); *A43B 7/146* (2013.01); *A43B 7/148* (2013.01); *A43B 7/1455* (2013.01); *A43B 7/1485* (2013.01); *A43B 17/00* (2013.01)

(58) Field of Classification Search
CPC ..... A43B 7/149; A43B 7/146; A43B 17/00; A43B 7/148; A43B 7/1465; A43B 7/14; A43B 7/1485; A43B 7/1455
USPC ..... 36/141, 43, 44, 88, 102, 140
See application file for complete search history.

(56) References Cited

U.S. PATENT DOCUMENTS

| | | | | |
|---|---|---|---|---|
| 4,598,484 | A * | 7/1986 | Ma | 36/3 R |
| 5,235,761 | A * | 8/1993 | Chang | 36/3 R |
| 5,502,901 | A * | 4/1996 | Brown | 36/28 |
| 5,607,749 | A * | 3/1997 | Strumor | 428/156 |
| 5,682,690 | A * | 11/1997 | Chang | 36/141 |
| 6,082,024 | A * | 7/2000 | Del Biondi | 36/28 |
| 7,013,588 | B2 * | 3/2006 | Chang | 36/141 |
| 2004/0230139 | A1 * | 11/2004 | Chang | 601/15 |
| 2006/0213091 | A1 * | 9/2006 | Ometto et al. | 36/141 |
| 2008/0010868 | A1 * | 1/2008 | Tsai | 36/141 |
| 2009/0282704 | A1 * | 11/2009 | Park | 36/3 B |

(Continued)

FOREIGN PATENT DOCUMENTS

| | | | | |
|---|---|---|---|---|
| DE | 202013103873 | U1 * | 11/2013 | |
| WO | WO 2007148910 | A1 * | 12/2007 | A43B 7/06 |

(Continued)

*Primary Examiner* — Jila M Mohandesi
*Assistant Examiner* — Katharine Gracz
(74) *Attorney, Agent, or Firm* — Ladas & Parry LLP

(57) ABSTRACT

A massaging shoe pad comprising a base layer, first plates and second plates, is disclosed. The base layer has accommodation spaces having first and second openings. First plates are disposed in each accommodation space. One end of each first plate is connected to the side wall of each accommodation space respectively. The other end of each first plate protrudes from the first opening forming the first protrusion. Between the two ends, each first plate protrudes from the accommodation chamber, which has through holes, toward the second opening. Second plates are disposed in each accommodation space and one end of each second plate is moveably inserted through the through hole. The other end of each second plate protrudes out of the first opening forming the second protrusion. When the second plate moves from a first to a second location, the second protrusion props against the other end of the first plate.

7 Claims, 5 Drawing Sheets

(56) References Cited

U.S. PATENT DOCUMENTS

2010/0139124 A1* 6/2010 Kim ..... 36/103
2012/0030969 A1* 2/2012 Lim ..... 36/141

FOREIGN PATENT DOCUMENTS

WO WO 2012127109 A1 * 9/2012
WO WO 2013022850 A1 * 2/2013

* cited by examiner

MASSAGING SHOE PAD

TECHNICAL FIELD OF THE INVENTION

This invention relates to a shoe pad, specifically a massaging shoe pad massages the sole of the foot.

DESCRIPTION OF PRIOR ART

The daily life of humans requires transportation by feet. The most important device for long-time walking is the pair of shoes that wraps people's feet. Labor workers, doctors, nurses, and teachers, among other people wear occupational footwear all day standing or walking. Inappropriate choices of shoes, in the short term, may result in discomfort or even diseases, and in the long term these shoes may cause foot diseases and pathological changes in other parts in the human body.

To make shoes more comfortable, people usually add a shoe pad inside their shoes to keep their soles dry and clean. However, general shoe pads on the market do not provide the function of stimulating sole acupoints and enhancing blood circulation. In addition, shoe manufacturers install a shock absorption structure in the bottom of shoes to absorb shock and vibration. This design is costly and does not provide the function of stimulating sole acupoints and enhancing blood circulation.

SUMMARY OF THE INVENTION

To remedy the deficiency of the prior art, the primary object of this invention is to provide a massaging shoe pad that is effective in stimulating sole acupoints and enhancing blood circulation, whereas existing shoe pads are only capable of breathability, odor removal, and shock absorption.

Based on this object, a massaging shoe pad is disclosed, which comprises a base layer, a plurality of first plates and a plurality of second plates, is disclosed. The base layer has a plurality of accommodation spaces having a first opening and a second opening located at two sides of the base layer respectively. A plurality of first plates is individually disposed in each accommodation space and one end of each first plate is connected to the side wall of each accommodation space respectively. The other end of each first plate protrudes out of the first opening and forms the first protrusion. Between the two ends, each first plate protrudes out of the accommodation chamber, which has through holes, toward the second opening. A plurality of second plates is disposed in each accommodation space and one end of each second plate is moveably inserted through the through hole. The other end of each second plate protrudes out of the second opening and forms the second protrusion. When the second plate is moved from a first location to a second location, the second protrusion props against the other end of the first plate.

When the second protrusion props against the other end of the first plate, the other end of the first plate is elastically deformed along the direction toward the first opening.

The both ends of each of the second plates protrude toward the direction of the second opening and form bulges, and when the second plate is moved to a second location, each bulge props against one side of the accommodation chamber.

When the second plate is moved from a second location to a first location, the other end of each second plate props against the other side of the side wall of the accommodation space.

Preferably, the present message shoe pad includes a first pad, which is attached to one side of the base layer, and each first pad has first via holes that correspond to all accommodation spaces respectively.

When the second plate is moved to a second location and props against the other end of the first plate, all first protrusions protrude out of the first via holes respectively and are higher than one side of the first pad.

The first pad could be made of plastics, foam, rubber, silica gel, water-resistant textile, water-resistant non-woven textile, or canvas.

Preferably, the massaging shoe pad also includes a second pad, which is attached to the other side of the base layer, and each second pad has second via holes that correspond to all accommodation spaces.

The second pad could be made of plastics, water-resistant textile, water-resistant non-woven textile, or canvas.

The through holes are perpendicular to the direction of the second opening.

As mentioned, the present massaging shoe pad has the following advantages:

(1) The second plate of the present invention is adjustable to make the first protrusion protrudes out of the surface of the first pad, thereby massaging sole acupoints, relieving sole pressure, and enhancing blood circulation.

(2) The first and second pads of the present invention provide good protection and support for human soles by absorbing and dividing sole pressure.

DETAILED DESCRIPTION OF THE PREFERRED EMBODIMENTS

Figure 1:
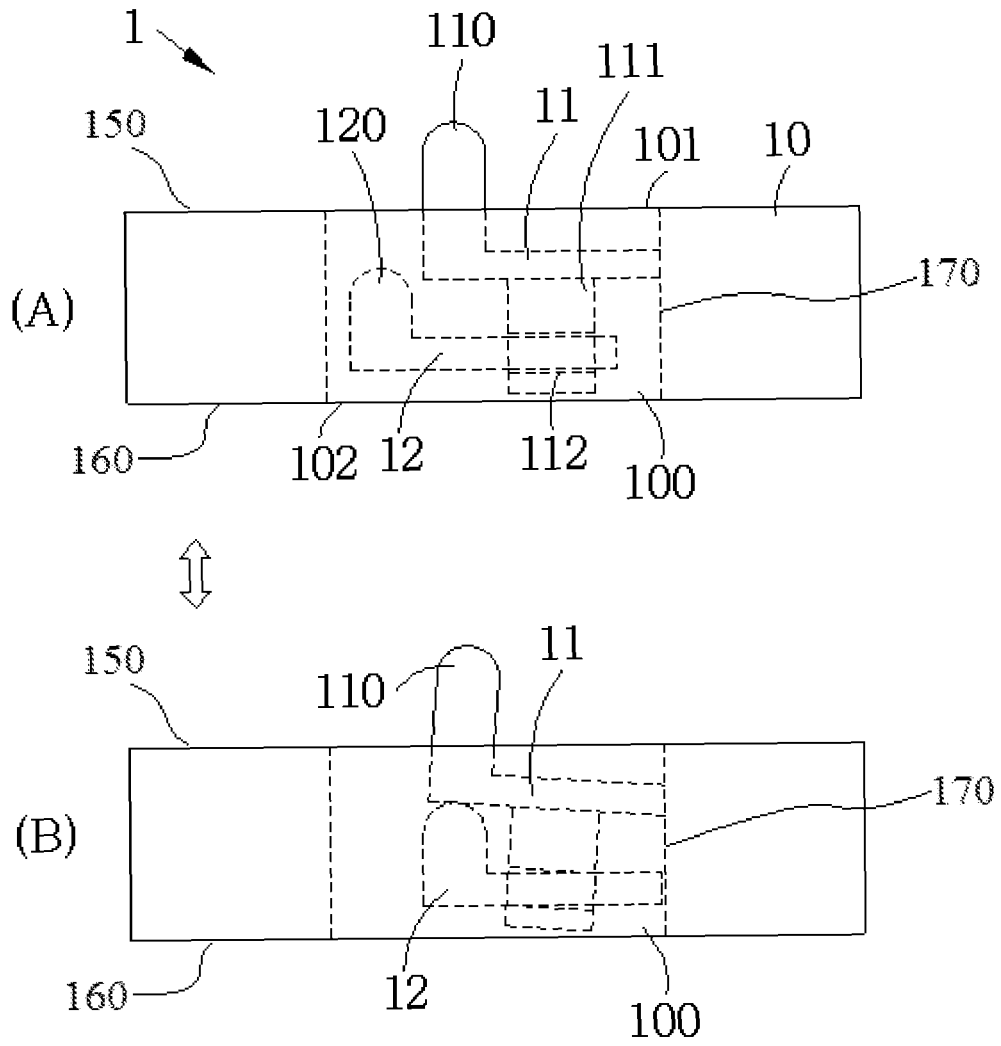
FIG. 1 is the first perspective view of the present invention.

The present invention will now be described with some preferred embodiments thereof and with reference to the accompanying drawings. For the purpose of easy to understand, elements that are the same in the preferred embodiments are denoted by the same reference numerals.

Figure 2:
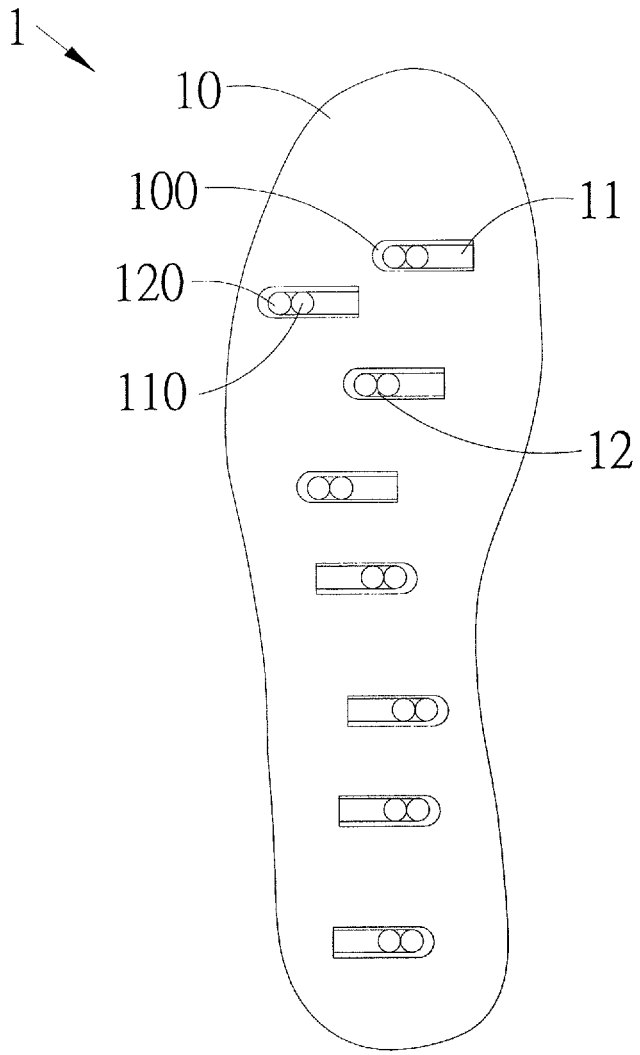
FIG. 2 is the second perspective view of the present invention.
Figure 3:
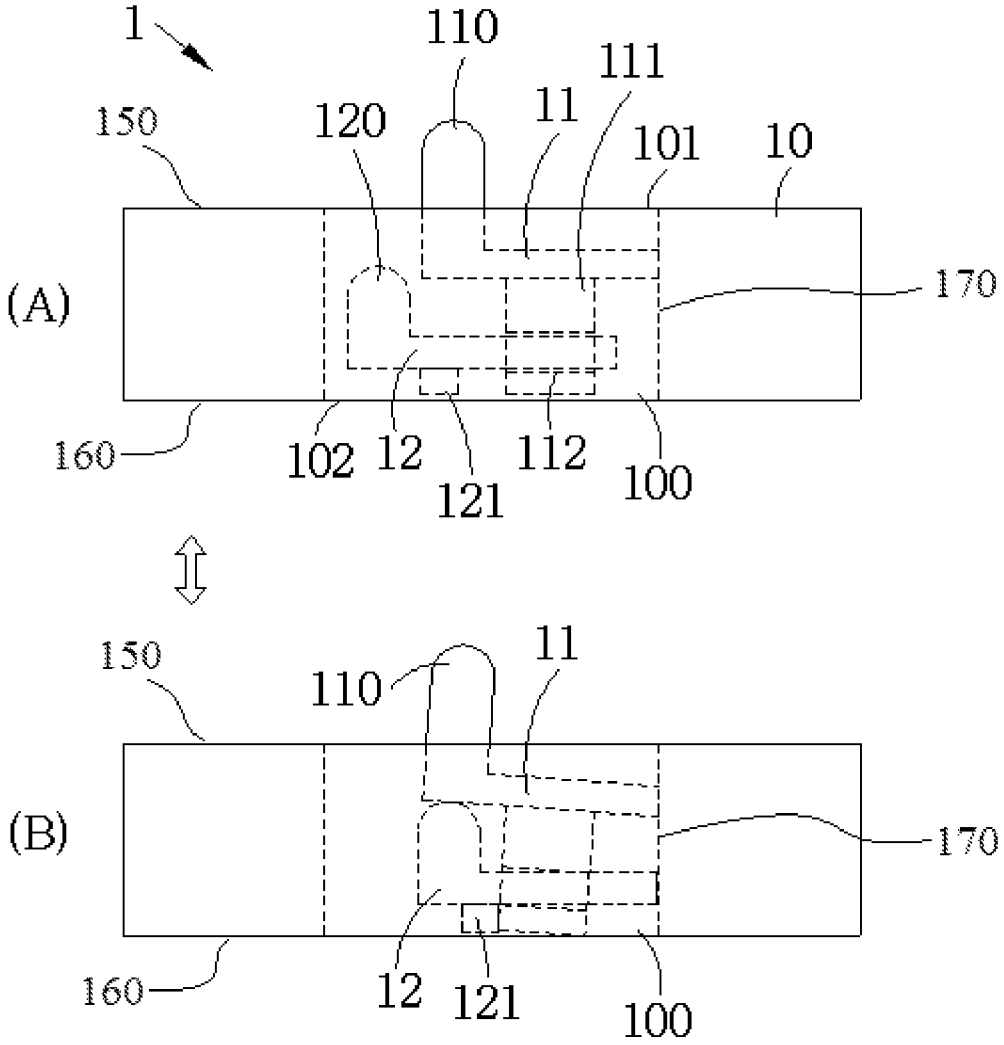
FIG. 3 is the third perspective view of the present invention.

Please refer to FIGS. 1 to 3, which refer to the three perspective embodiments of the present invention, a massaging shoe pad. As shown in the figures, the massaging shoe pad 1 includes a base layer 10, a plurality of first plates 11, and a plurality of second plates 12. The base layer 10 includes a plurality of accommodation spaces 100 and can be made of plastic or metal. On the two sides of the base layer 10 (i.e., a first lateral side surface 150 and a second lateral side surface 160), each accommodation space 100 includes a first opening 101, which is formed in the first lateral side surface 150, and a second opening 102, which is formed in the second lateral side surface 160. A plurality of first plates 11 is disposed in each accommodation space 100. One end of each of the first plates 11 is attached to one side wall 170 of the accommodation space 100, and the other end projects toward the first opening 101 and forms a first projection 110. Each of the first plates 11 includes an accommodation arm 11 that is disposed between the two ends of the first plate 11. The accommodation arm 111 projects toward the second opening 102. Each accommodation arm 111 includes through holes 112, which is perpendicular to the direction of the second opening 102. Each of the plurality of second plates 12 is disposed separately in each accommodation space 100, and one end of the second plate 12 is moveably inserted through a through hole 112, while the other end protrudes toward the first opening 101 and forms a second protrusion 120. When each second plate 12 is moved from a first location to a second location, each second protrusion 120 props against the other end of each first plate 11. In addition, when the second protrusion 120 props against the other end of the first plate 11, the other end of the first plate 11 is elastically deformed along the direction toward the first opening 101.

The base layer 10 of the present invention contains a plurality of accommodation spaces 100 (FIG. 2), and the location of each accommodation space 100 is designed according to different foot sizes of people of different figures and corresponding acupoints. Each of the accommodation spaces 100 includes first plates 11 and second plates 12. One end of each first plate 11 is attached to the side wall 170 of the accommodation space 100, wherein the first plate 11 is integrally formed with the base layer 10. Each first plate 11 protrudes out of the first opening 101 and forms a first protrusion 110, which functions to massage human soles. Between the two ends, the first plate 11 includes an accommodation arm 111 that protrudes toward the second opening 102. Each of the accommodation arms 111 includes a through hole 112. The One end of each second plate 12 is moveably inserted through each through hole 112, and the other end of each second plate 12 protrudes out of the first opening 101 and forms a second protrusion 120.

Therefore, when users move the second plate 12 from a first location (FIG. 1(A)) to a second location (FIG. 1(B)), one end of the second protrusion 120 props against one side of the other end of the first plate 11, thereby making the other end of the first plate 11 elastically deformed along the direction toward the first opening 101. The elastic deformation causes the first protrusion 110 to bulge upward toward the first opening 101.

In FIG. 3, each second plate 12 of the present invention protrudes between the two ends toward the second opening 102 and forms a bulge 121. When each second plate 12 is moved from a first location (FIG. 3(A)) to a second location (FIG. 3(B)), each bulge 121 props against one side of each accommodation arm 111.

When each second plate 12 is moved from a second location to a first location, the other side of each second plate 12 props against the other end of the side wall 170 of each accommodation space 100.

Through the bulge 121, the present invention allows users to precisely move the second plate 12 to a second location, in order to avoid inappropriate location adjustment of the second plate 12, resulting in the second protrusion 120 not precisely being propped to the other end of the first plate 11. Moreover, when users move the second plate 12 from a second location to a first location, the other end of the second plate 12 can be propped against the other side of the side wall of the accommodation space 100, in order to prevent the second plate 12 from coming off the through hole 112.

Figure 4:
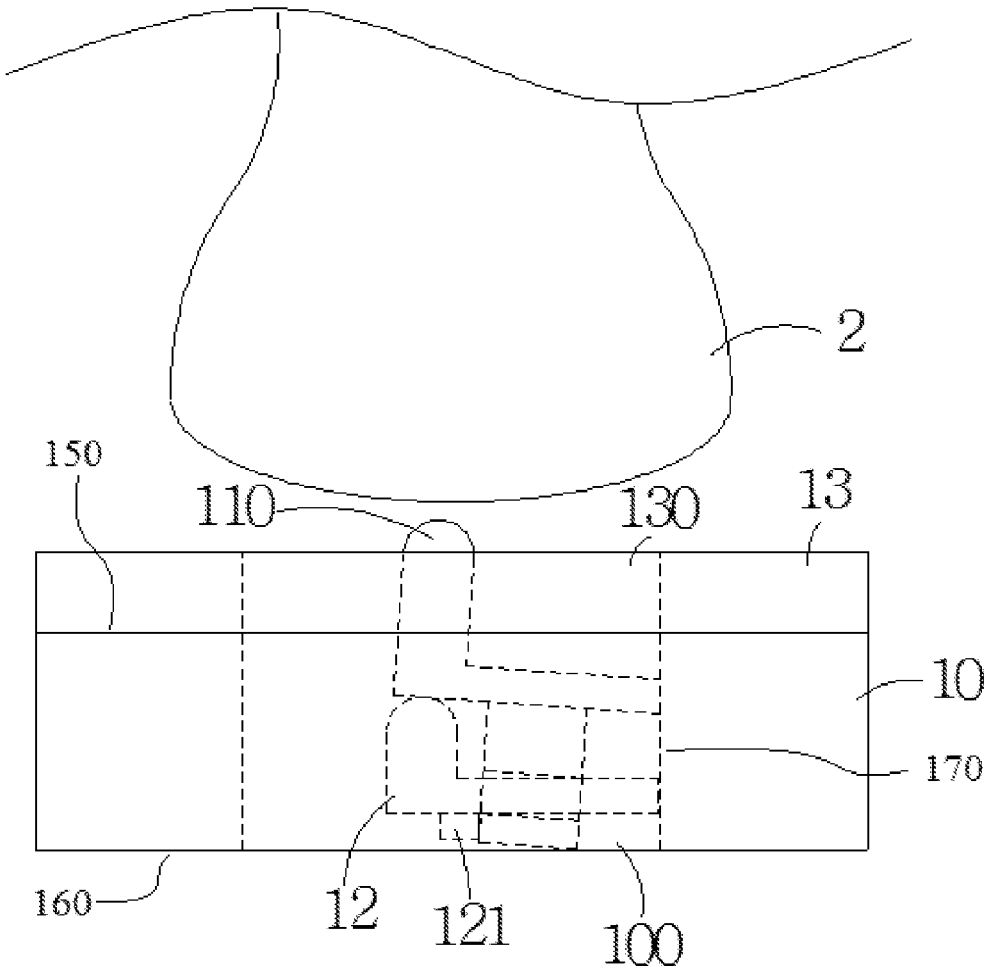
FIG. 4 is a view of the first embodiment of the present invention.

FIG. 4 shows a perspective view of the first embodiment of the present invention. Please also refer to FIGS. 1 to 3. The component movements of the massaging shoe pad 1 of this embodiment are similar to the movements of the same components in the massaging shoe pad described above and will not be described again. However, in this preferred embodiment, the massaging shoe pad 1 includes a first pad 13, which is attached to the first lateral side surface of the base layer 10 and contains first via holes 130 that correspond to each accommodation space 100. The first pad could be made of plastics, foam, rubber, silica gel, water-resistant textile, water-resistant non-woven textile, or canvas.

When each second plate 12 is moved to a second location and propped against the other end of the corresponding first plate 11, each first protrusion 110 protrudes out of each first via hole 130 and is higher than one side of the first pad 13.

To provide good protection, support, shock absorption, and pressure division for the user's foot sole 2, the present invention attaches a first pad 13 to one side of the base layer 10 in the massaging shoe pad 1. Moreover, to operate the massaging shoe pad 1, the second plate 12 could be adjusted to a second location to make one end of the second protrusion 120 prop one side of the other end of the first plate 11. Consequently the first protrusion 110 protrudes more upward out of the first via hole 130, higher than one side of the first pad 13. Through the above mechanism, the acupoints of the user's sole 2, when stepping on the massaging pad 1, can be massaged, sole pressure relieved, and blood circulation enhanced.

Figure 5:
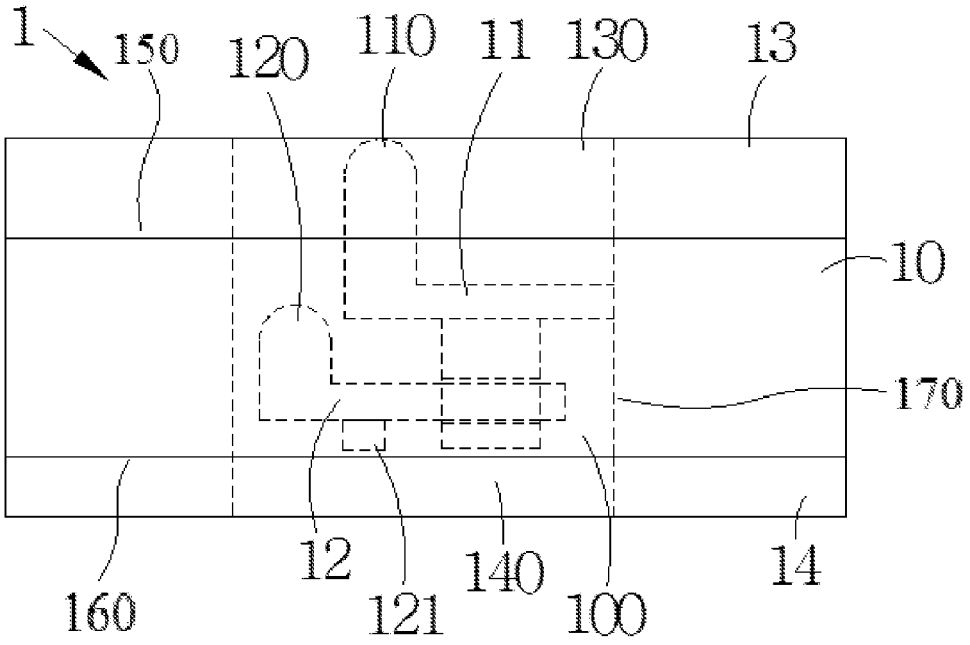
FIG. 5 is a view of the second embodiment of the present invention.

FIG. 5 is a perspective view of the second embodiment of the present invention. Please also refer to FIGS. 1 to 4.

The component movements of the massaging shoe pad 1 of this embodiment are similar to the movements of the same components in the massaging shoe pad described in the first embodiment and will not be described again. However, in this preferred embodiment, the massaging shoe pad 1 includes a second pad 14, which is attached to the second lateral side surface of the base layer 10 and contains second via holes 140 that correspond to each accommodation space 100. The second pad could be made of plastics, water-resistant textile, water-resistant non-woven textile, or canvas.

To provide good protection, support, shock absorption, and pressure division for the user' s foot sole 2, the present invention attaches a second pad 14 to the other side of the base layer 10 in the massaging shoe pad 1. This design prevents the circumstance when the user step on an object, the reaction force of which squeezes the bottom of the shoe, pushes the second plate 12, and may damage the second plate 12 and relevant components.

The present invention has been described with some preferred embodiments thereof and it is understood that many changes and modifications in the described embodiments can be carried out without departing from the scope and the spirit of the invention that is intended to be limited only by the appended claims.

BRIEF DESCRIPTION OF THE DRAWINGS

1: Massaging shoe pad
10: Base layer
100: Accommodation space
101: First opening
102: Second opening
11: First plate
110: First protrusion
111: Accommodation chamber
112: Through hole
12: Second plate
120: Second protrusion
121: Bulge
13: First pad
130: First via hole
14: Second pad
140: Second via hole
2: Sole

The invention claimed is:

1. A massaging shoe pad, comprising:

a base layer comprising a plurality of accommodation spaces, wherein each of the accommodation spaces extends through the base layer from a first opening in a first lateral side of the base layer to a second opening in a second lateral side of the base layer;

a plurality of first plates, which are separately disposed in each accommodation space, each of the plurality of first plates comprising:

a first end attached to a side wall of the corresponding accommodation space;

a second end protruding out of the first opening and forming a first protrusion;

an accommodation arm disposed between the first end and the second end, the accommodation arm projecting towards the second opening, the accommodation arm comprising a through hole that is perpendicular to the direction of the second opening; and a plurality of second plates which are separately disposed in each accommodation space, each of the plurality of second plates comprising:

a first end moveably inserted through the through hole of the corresponding first plate;

a second end protruding toward the corresponding first opening and forming a second protrusion;

wherein, when the second plate is moved from a first location to a second location the second protrusion props against the second end of the corresponding first plate.

2. The massaging shoe pad as claimed in claim 1, wherein when the second protrusion props against the second end of the first plate, the second end of the first plate is elastically deformed along the direction toward the first opening.

3. The massaging shoe pad as claimed in claim 1, wherein the second plate further comprises a bulge disposed between the first and second ends of the second plate, the bulge protruding towards the second opening;

wherein when the second plate is moved to the second location, the bulge props against a side of the corresponding accommodation arm.

4. The massaging shoe pad as claimed in claim 1, further comprising:

a first pad attached to the first lateral side of the base layer the first pad comprising a plurality of first holes aligned with the plurality of accommodation spaces;

wherein when the second plate is in the second location and propped against the second end of the corresponding first plate, the first protrusion of the corresponding first plate protrudes out of the corresponding first hole and is higher than one side of the first pad.

5. The massaging shoe pad as claimed in claim 1, further comprising:

a second pad attached to the second lateral side of the base layer, the second pad comprising:

a plurality of second holes aligned with the plurality of accommodation spaces.

6. The messaging shoe pad as claimed in claim 4, wherein the first pad is made of one of plastic, foam, silica gel, water-resistant textile, water-resistant non-woven textile, or canvas.

7. The messaging shoe pad as claimed in claim 5, wherein the second pad is made of one of plastic, water-resistant textile, water-resistant non-woven textile, or canvas.

* * * * *